US008931407B2

(12) United States Patent
Shih

(10) Patent No.: US 8,931,407 B2
(45) Date of Patent: Jan. 13, 2015

(54) STAMP ASSEMBLY

(71) Applicant: Sun Same Enterprises Co., Ltd., Tainan (TW)

(72) Inventor: Hsu-Shen Shih, Tainan (TW)

(73) Assignee: Sun Same Enterprises Co.,.Ltd., Tainan (TW)

( * ) Notice: Subject to any disclaimer, the term of this patent is extended or adjusted under 35 U.S.C. 154(b) by 0 days.

(21) Appl. No.: 13/920,313

(22) Filed: Jun. 18, 2013

(65) Prior Publication Data

US 2014/0196622 A1 Jul. 17, 2014

(30) Foreign Application Priority Data

Jan. 16, 2013 (TW) ..... 102200908 U

(51) Int. Cl.
*B41K 1/40* (2006.01)
*B41K 1/42* (2006.01)

(52) U.S. Cl.
CPC ... *B41K 1/40* (2013.01); *B41L 1/38* (2013.01); *B41K 1/42* (2013.01)
USPC ..... 101/334; 101/405; 101/104

(58) Field of Classification Search
CPC ..... B41K 1/006; B41K 1/54; B41K 1/42; B41K 1/02; B41K 1/40; B41K 1/36; B41K 1/52
USPC ..... 101/103, 104, 109, 327, 333, 334, 405, 101/406
IPC ..... B41K 1/38,1/36, 1/40
See application file for complete search history.

(56) References Cited

U.S. PATENT DOCUMENTS

| | | | | |
|---|---|---|---|---|
| 5,649,485 | A * | 7/1997 | Dour et al. | 101/334 |
| 6,945,172 | B1 * | 9/2005 | Shih | 101/333 |
| 2005/0145127 | A1 * | 7/2005 | Zindl et al. | 101/333 |
| 2011/0277647 | A1 * | 11/2011 | Zindl et al. | 101/334 |

* cited by examiner

*Primary Examiner* — Leslie J Evanisko
(74) *Attorney, Agent, or Firm* — Rosenberg, Klein & Lee

(57) ABSTRACT

A stamp assembly has a bracket, a stamping member, an ink cartridge, a spring, a housing and a pushing device. The stamping member is mounted in the bracket and is capable of being moved in a longitudinal direction relative to the bracket and being rotated. The ink cartridge and the spring are mounted in the bracket. The housing is mounted around the bracket and has a through hole formed through a front side of the housing. The pushing device is mounted on the front side of the housing and has a pushed member. The pushed member is slidably mounted in the through hole and is capable of pushing the ink cartridge out of the bracket. With the pushing device, the stamp assembly is convenient for a user to push and remove the ink cartridge.

7 Claims, 12 Drawing Sheets

STAMP ASSEMBLY

BACKGROUND OF THE INVENTION

1. Field of the Invention

The present invention relates to a stamp assembly, and more particularly to a stamp assembly that is convenient for a user to push and remove an ink cartridge.

2. Description of Related Art

With reference to FIG. 14, a conventional stamp assembly has a housing 8, a bracket 9, a stamping member, a spring, two buttons, two rod sections, two driven sections and a pad.

The housing 8 has a front side and a front recess 80 formed in the front side of the housing 8. The housing 8 is mounted around the bracket 9 and can be pushed downwardly.

The bracket 9 has an ink cartridge 90. The ink cartridge 90 is located in a top of the bracket 9, faces the front recess 80 and can be pushed in a latitudinal direction relative to the bracket 9 for detachment.

The stamping member is mounted in the housing 8, is mounted below the ink cartridge 90 and is capable of being moved in a longitudinal direction relative to the housing 8 and being rotated.

The spring is mounted in the housing 8 and presses against the housing 8 and the bracket 9 to provide a recovering force for the housing 8 and the bracket 9 to return to the original position.

The buttons are respectively mounted on two opposite sides of the housing 8 and are capable of securing the housing 8 to the bracket 9.

The rod sections are respectively formed on two opposite sides of the stamping member, are mounted through the bracket 9 and can be guided by the housing 8. Accordingly, the stamping member can be moved in a longitudinal direction relative to the bracket 9.

The driven sections are respectively formed on the rod sections and allow the stamping member to be rotated.

The pad is located between the stamping member and the ink cartridge, is securely mounted on the stamping member, and abuts on the ink cartridge.

When the conventional stamp assembly is being operated to stamp a mark on an object, the stamping member and the pad are moved downwardly and then are rotated for stamping. When the housing 8 is loosened, the spring recovers to drive the housing 8 to move upwardly. During the movement of the housing 8, the driven sections, the stamping member and the pad are also rotated, and the housing 8 returns to an original position.

When the ink cartridge runs out of ink and needs to be replaced, the housing 8 is pushed downwardly for a specific distance.

The two buttons are then pushed such that the buttons are securely connected with the bracket 9, and the housing 8 is secured to the bracket 9.

Finally, the ink cartridge 90 is pushed directly by a finger of the user via the front recess 80. Accordingly, the ink cartridge 90 is pushed out of the bracket 9 for replacement.

However, the user's finger is likely to get stained by the ink because the finger directly touches the ink cartridge. Moreover, the finger has to pass through the narrow front recess 80 to push the ink cartridge 90, and this is very inconvenient.

In addition, the front side of the conventional stamp assembly does not have a good appearance because the ink cartridge 90 is exposed via the front recess 80.

To overcome the shortcomings, the present invention provides a stamp assembly to mitigate the aforementioned problems.

SUMMARY OF THE INVENTION

The main objective of the invention is to provide a stamp assembly that is convenient to push and remove an ink cartridge.

A stamp assembly has a bracket, a stamping member, an ink cartridge, a spring, a housing and a pushing device. The stamping member is mounted in the bracket and is capable of being moved in a longitudinal direction relative to the bracket and being rotated. The ink cartridge and the spring are mounted in the bracket. The housing is mounted around the bracket and has a through hole formed through a front side of the housing. The pushing device is mounted on the front side of the housing and has a pushed member. The pushed member is slidably mounted in the through hole and is capable of pushing the ink cartridge out of the bracket. With the pushing device, the stamp assembly is convenient for a user to push and remove the ink cartridge.

Other objects, advantages and novel features of the invention will become more apparent from the following detailed description when taken in conjunction with the accompanying drawings.

DETAILED DESCRIPTION OF PREFERRED EMBODIMENT

Figure 1:
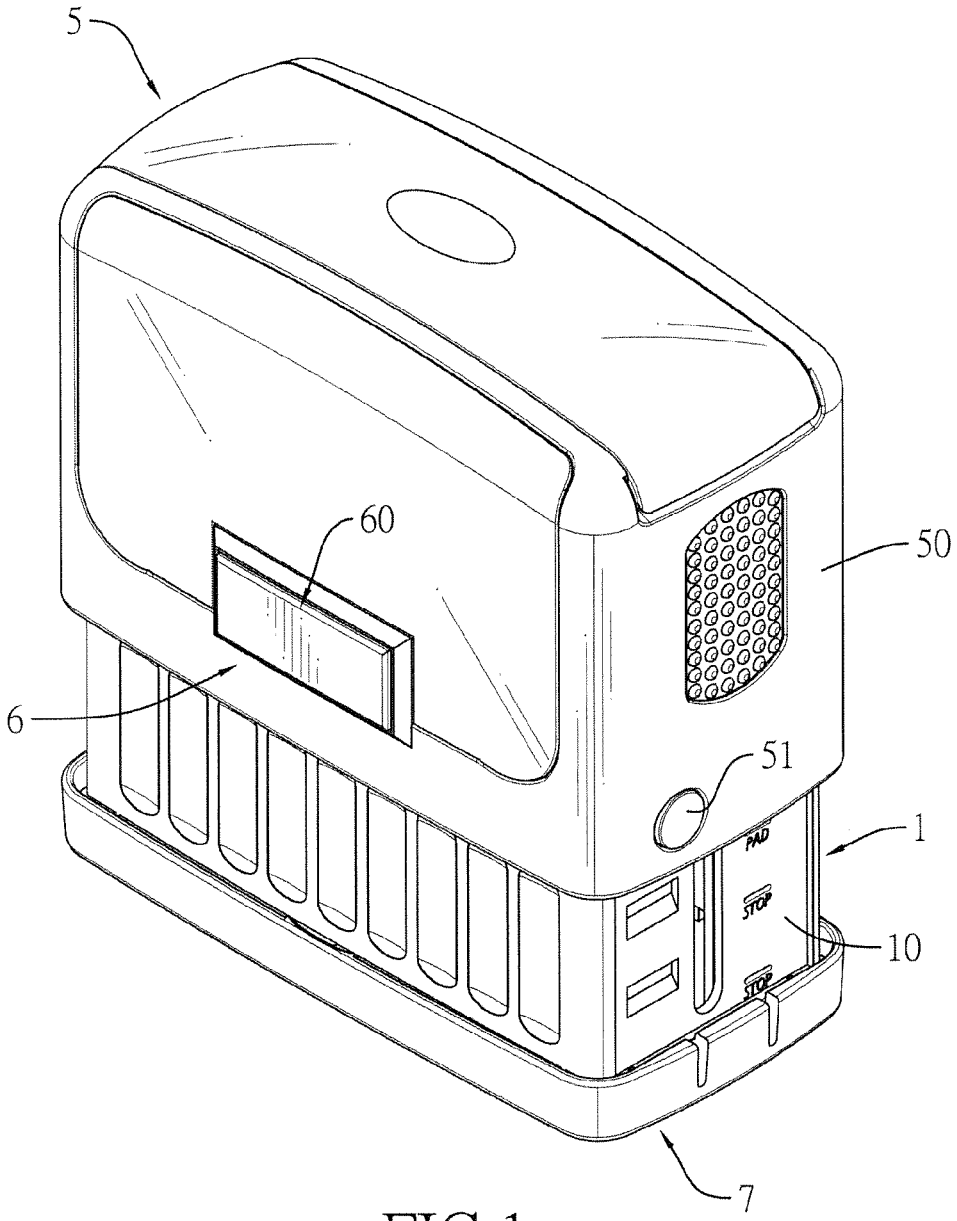
FIG. 1 is a perspective front view of a first embodiment of a stamp assembly in accordance with the present invention.
Figure 3:
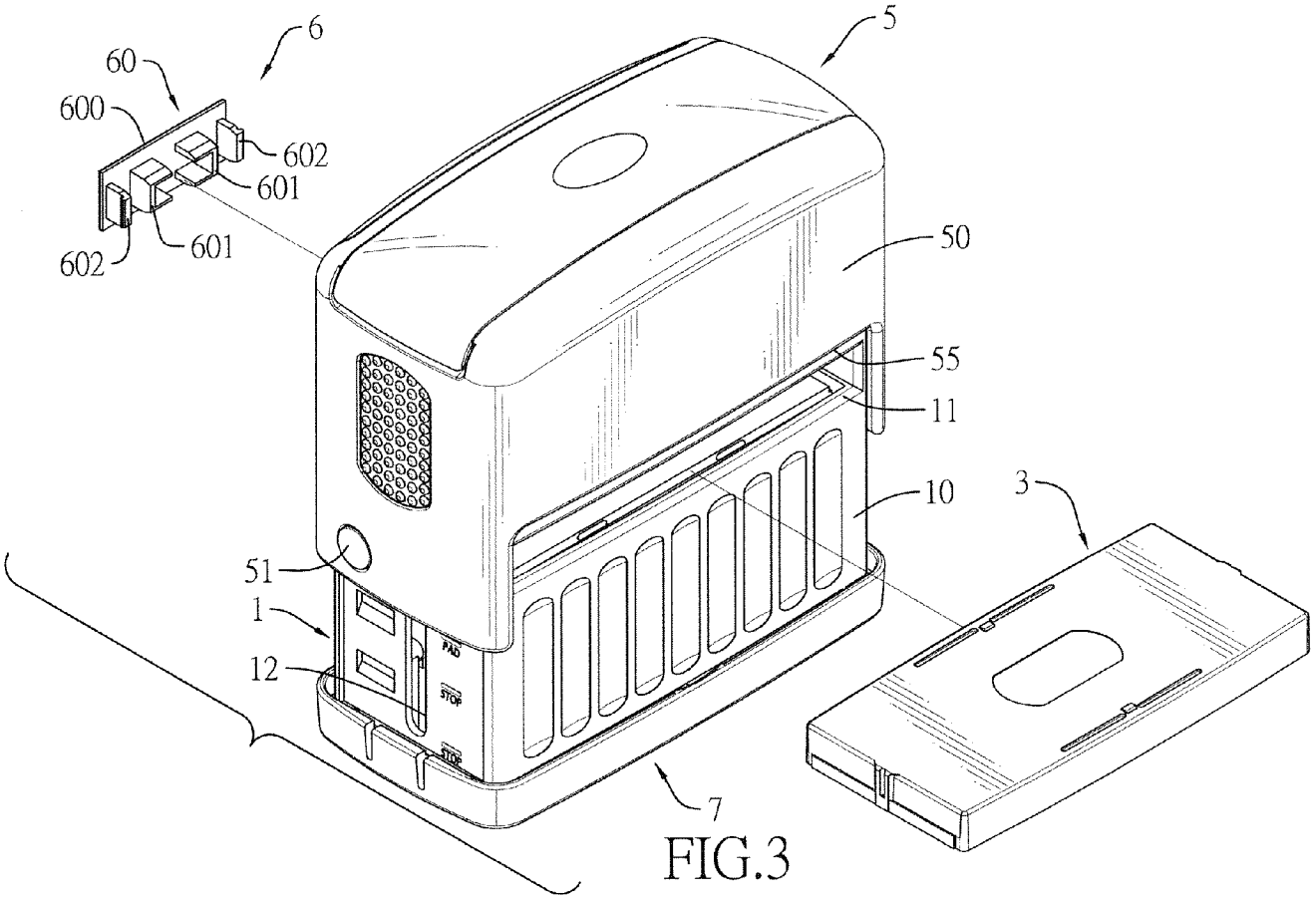
FIG. 3 is a partially exploded perspective view of the stamp assembly in FIG. 1.
Figure 7:
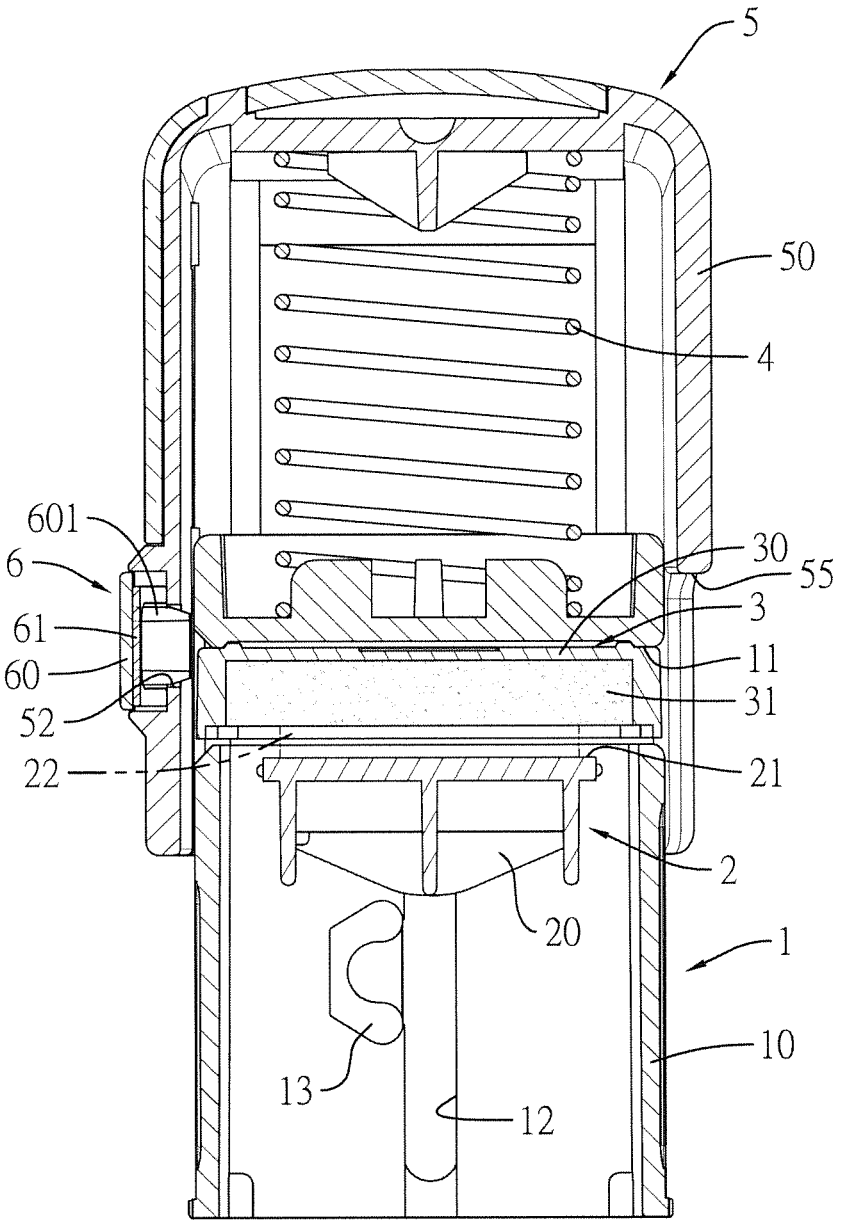
FIG. 7 is a side view in partial section of the stamp assembly along line 7-7 in FIG. 6.

With reference to FIGS. 1, 3 and 7, a first embodiment of a stamp assembly in accordance with the present invention comprises a bracket 1, a stamping member 2, an ink cartridge 3, a spring 4, a housing 5, a pushing device 6, and a bottom cover 7.

Figure 2:
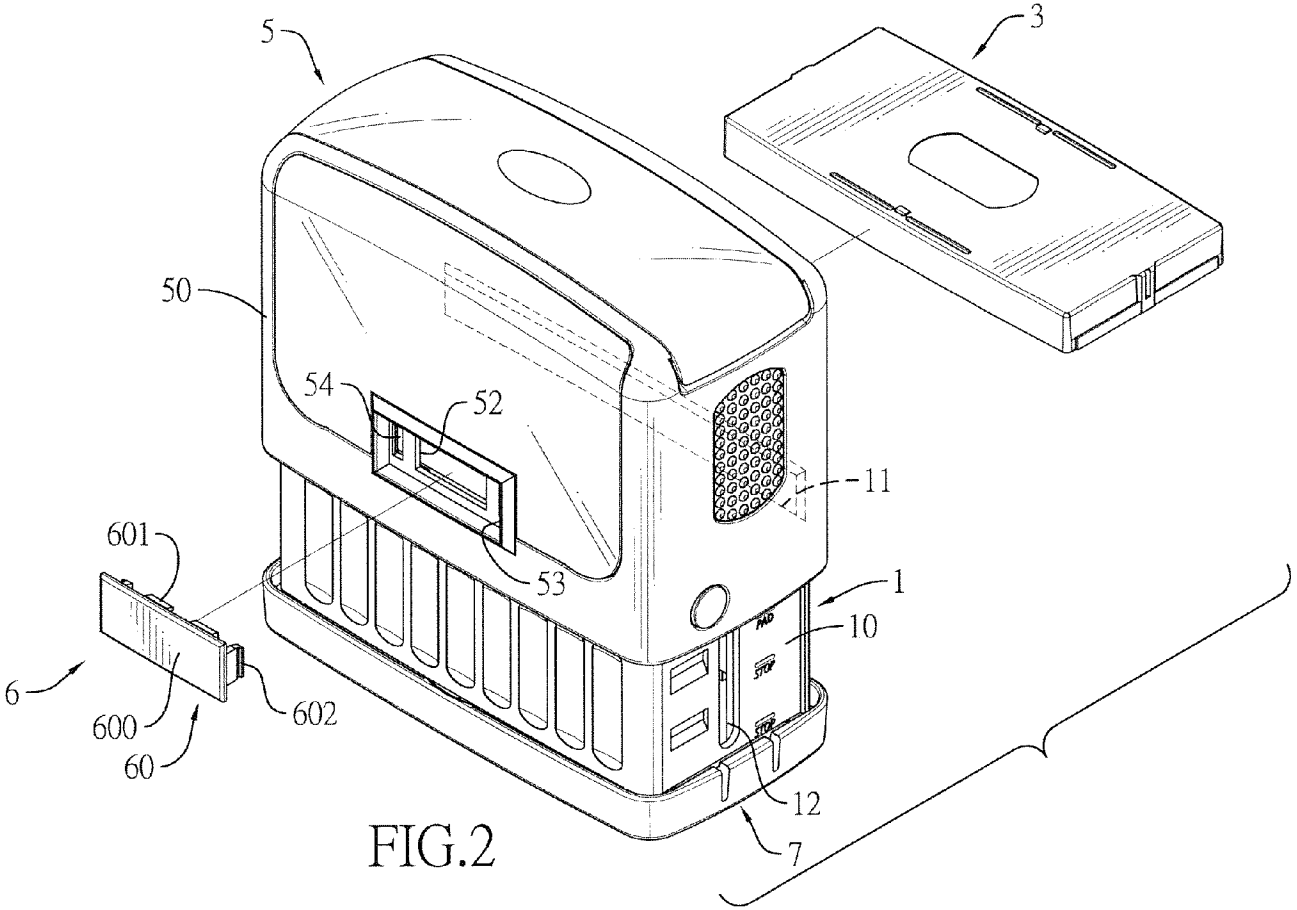
FIG. 2 is a partially exploded perspective view of the stamp assembly in FIG. 1.

With reference to FIGS. 2, 3 and 7, the bracket 1 has a main body 10, a bracket hole 11, two grooves 12, two button holes and two guiding portions 13.

The main body 10 has a top, a bottom, an opening and two opposite inner walls. The opening of the main body 10 is formed at the bottom of the main body 10.

The bracket hole 11 is formed through the top of the main body 10 of the bracket 1 in a latitudinal direction of the bracket 1.

The button holes are respectively formed through the inner walls of the main body 10.

The grooves 12 are respectively formed through the two opposite inner walls of the main body 10 and extend in a longitudinal direction of the bracket 1.

With reference to FIG. 7, the two guiding portions 13 are respectively formed on the two opposite inner walls of the main body 10 and are respectively adjacent to the two grooves 12. Each guiding portion 13 is C-shaped, protrudes from a corresponding one of the two inner walls of the main body 10, and has an opening facing a corresponding one of the two grooves 12.

With reference to FIG. 7, the stamping member 2 is mounted in the bracket 1 below the bracket hole 11, is capable of being moved in a longitudinal direction relative to the bracket 1 and being rotated, and has a seat 20, an attached portion 21, and a pad 22.

The seat 20 has a top, two opposite sides, two rod sections and two driven sections. The two rod sections are respectively formed on the two opposite sides of the seat 20 and are respectively and slidably mounted through the two grooves 12 such that the seat 20 can be moved along the grooves 12. The two driven sections are respectively formed on the two rod sections, and are capable of abutting on the guiding portions 13. Accordingly, the guiding portions 13 can rotate the driven sections, and the seat 20 can also be rotated. The attached portion 21 is formed on the top of the seat 20. The pad 22 is glued to the attached portion 21 and is formed with patterns or letters.

Figure 9:
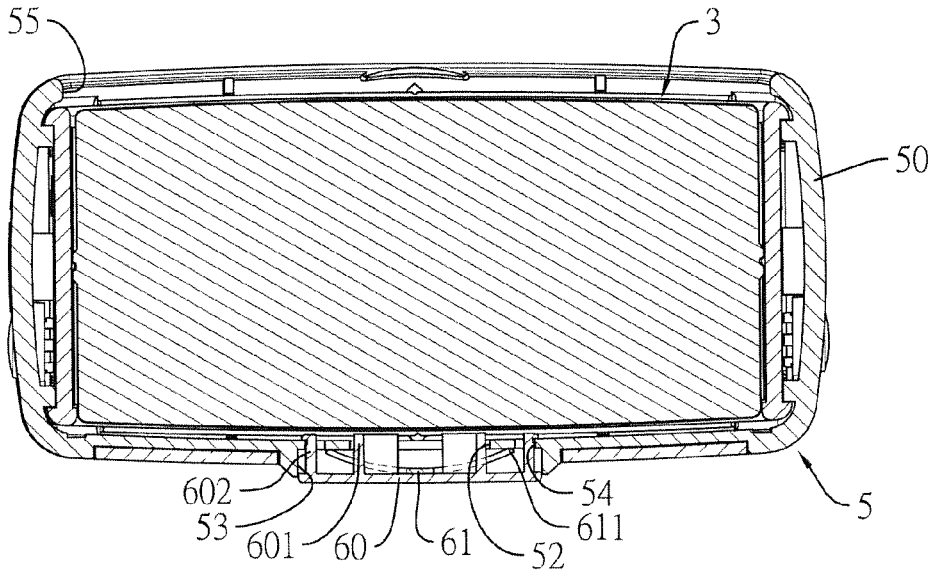
FIG. 9 is a cross sectional top view of the stamp assembly along line 9-9 in FIG. 6.

With reference to FIGS. 7 and 9, the ink cartridge 3 is mounted in the bracket hole 11 of the bracket 1 and has a box 30 and an ink-storage member 31. The ink-storage member 31 is mounted in the box 30 and has an ink surface. The ink surface of the ink-storage member 31 is abutted by the pad 22.

With reference to FIG. 7, the spring 4 is mounted in the bracket 10 and has a top end and a bottom end. The bottom end of the spring 4 is opposite to the top end of the spring 4 and presses against the top of the bracket 1.

With reference to FIGS. 2, 3, 7, and 9, the housing 5 is slidably mounted around the bracket 1, is capable of being moved in a longitudinal direction relative to the bracket 1, is connected with the stamping member 2, and has a shell 50, two buttons 51, a through hole 52, a recess 53, an aperture 54 and a shell hole 55.

The shell 50 is mounted around the bracket 1, is capable of being moved in a longitudinal direction relative to the bracket 1, and has a bottom, an opening, a front side, a rear side, two opposite flanks, and two opposite inner walls. The opening of the shell 50 is formed at the bottom of the shell 50. The rear side of the shell 50 is opposite to the front side of the shell 50. The two rod sections of the seat 20 are respectively and rotatably mounted in the two inner walls of the shell 50. Accordingly, when the shell 50 is moved in a longitudinal direction relative to the bracket 1, the seat 20 can be accordingly moved in the same direction.

The two buttons 51 are respectively mounted on the two flanks of the shell 50 and can be detachably and securely connected with the bracket 1 such that the housing 5 is secured to the bracket 1.

The through hole 52 is formed through the front side of the shell 50.

The recess 53 is formed in the front side of the shell 50 and has a bottom. The through hole 52 is formed through the bottom of the recess 53.

The aperture 54 is formed through the front side of the shell 50 and is adjacent to the through hole 52. The aperture 54 is formed through the bottom of the recess 53.

The shell hole 55 is formed through a bottom of the rear side of the shell 50 such that a bottom surface of the rear side of the shell 50 is located above a bottom surface of the front side of the shell 50. The ink cartridge 3 is located between the shell hole 55 and the through hole 52. When the ink cartridge 3 faces the shell hole 55 and the through hole 52, the two buttons 51 are pushed and respectively inserted into the two button holes such that the housing 5 is held in position.

Preferably, the shell 50 further has an additional aperture 54. The additional aperture 54 is formed through the bottom of the recess 53 of the shell 50. The two apertures 54 are respectively adjacent to the through hole 52 on two opposite sides of the through hole 52.

With reference to FIGS. 2, 3, 7 and 9, the pushing device 6 is mounted in the recess 53 of the housing 5 and has a pushed member 60.

The pushed member 60 is slidably mounted in the through hole 52 of the housing 5 and is capable of pushing the ink cartridge 3 out of the bracket 1. The pushed member 60 has a pushed portion 600, at least one protrusion 601, and a hook 602.

The pushed portion 600 has a cross section, a front side and a rear side. The cross section of the pushed portion 600 corresponds to a cross section of the recess 53 in shape. The front side of the pushed portion 600 may be provided with a trade mark or a pattern. The rear side of the pushed portion 600 is opposite to the front side of the pushed portion 600.

The at least one protrusion 601 is mounted on the rear side of the pushed portion 600, is mounted through the through hole 52, and is capable of pushing the ink cartridge 3. Preferably, the number of the at least protrusion 601 is two.

The hook 602 is mounted on the rear side of the pushed portion 600 beside the at least one protrusion 601, is mounted through the aperture 54, and is capable of restricting movement of the pushed member 60.

Preferably, the pushed member 60 further has an additional hook 602 mounted on the rear side of the pushed portion 600. The two hooks 602 are respectively inserted into the two apertures 54. The two protrusions 601 are both located between the two hooks 602, are mounted through the through hole 52, and are capable of pushing the ink cartridge 3.

Figure 4:
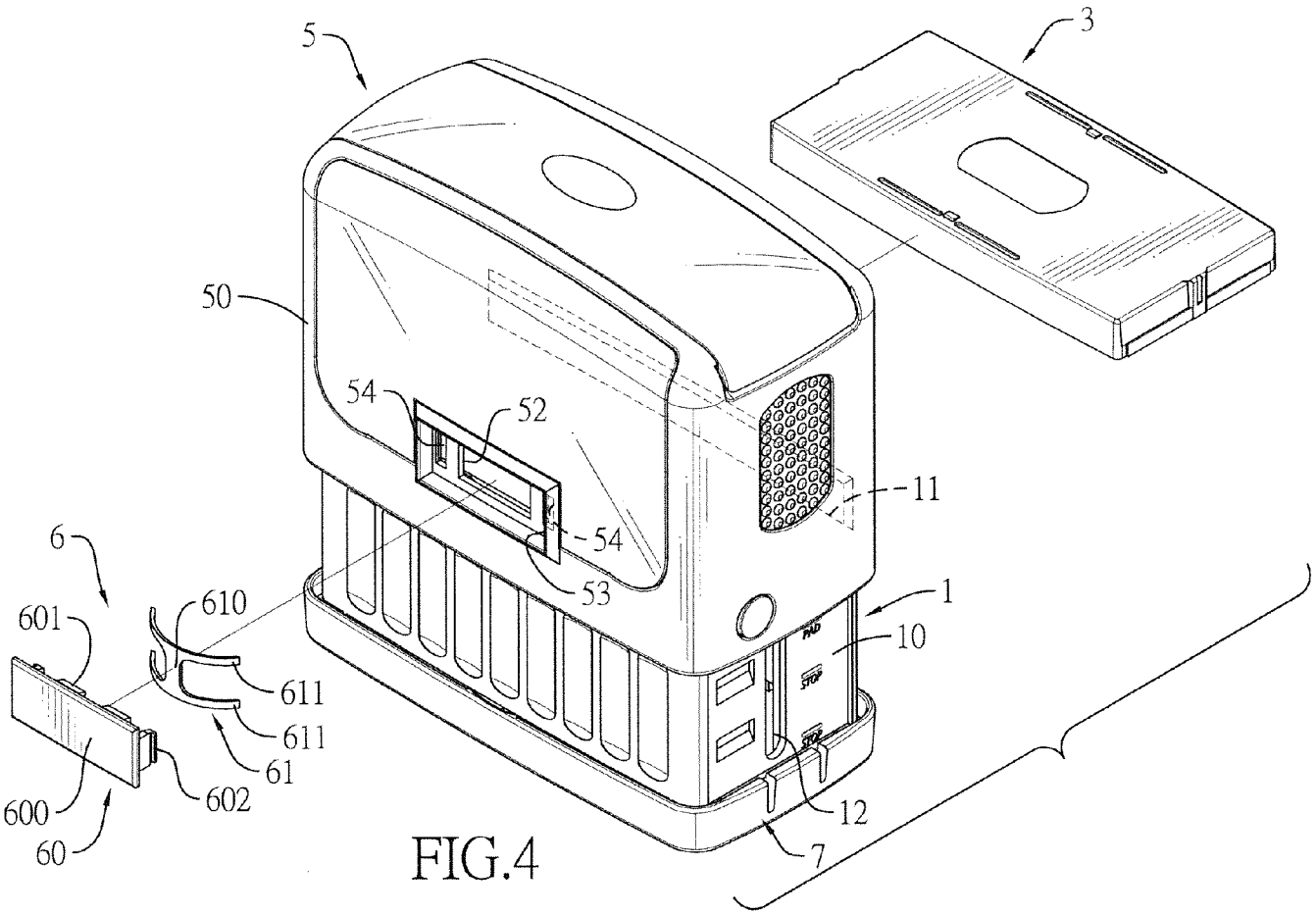
FIG. 4 is a partially exploded perspective view of the stamp assembly in FIG. 1 showing that the stamp assembly has an elastic member.
Figure 5:
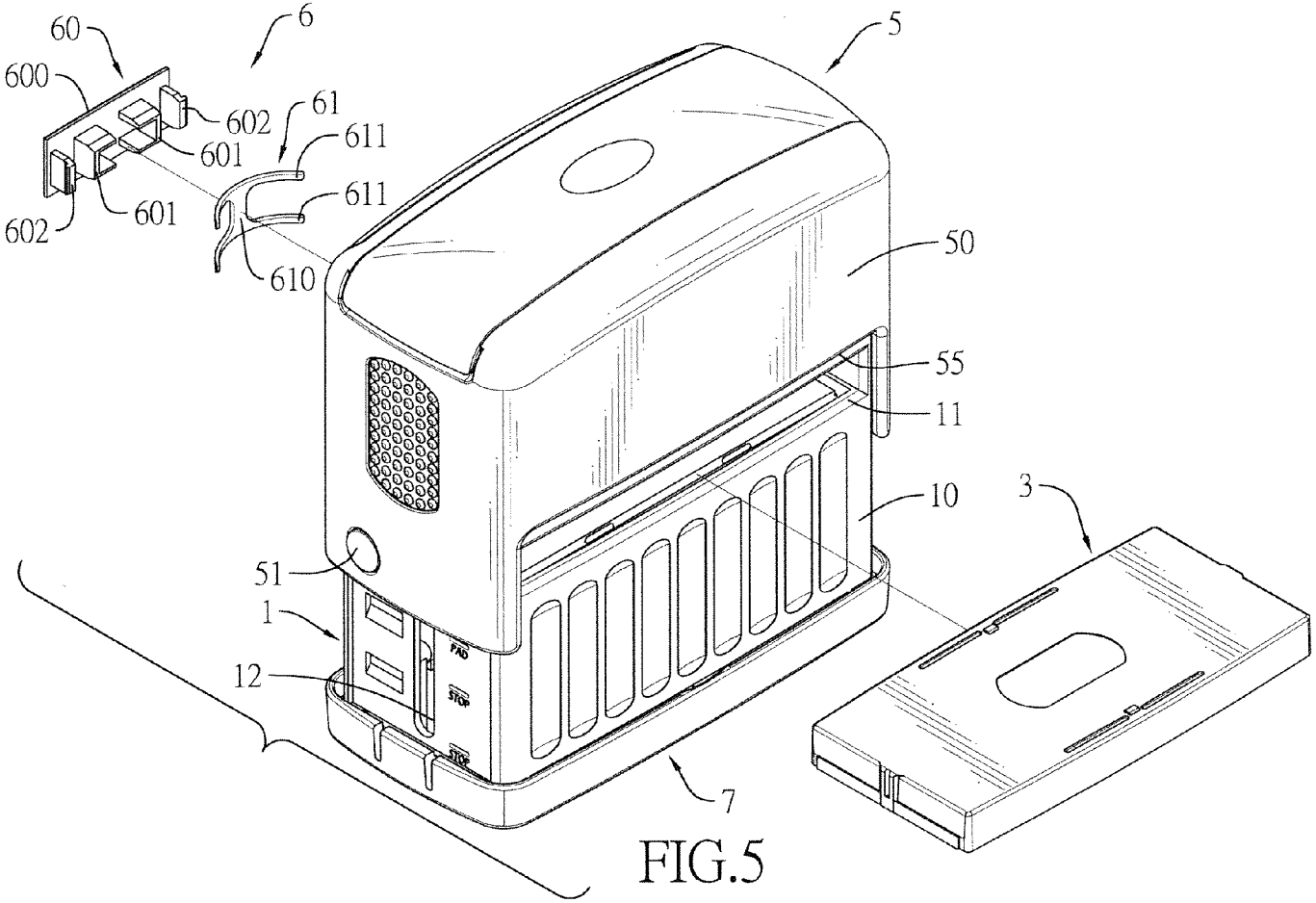
FIG. 5 is a partially exploded perspective view of the stamp assembly in FIG. 1 showing that the stamp assembly has the elastic member.

Preferably, with reference to FIGS. 4 and 5 the pushing device 6 further has an elastic member 61 mounted between the pushed member 60 and the shell 50 to provide a recovering force. The elastic member 61 is mounted between the pushed member 60 and the shell 50, is located between the protrusions 601 between the hooks 602, and has a base 610 and multiple elastic strips 611. The base 610 abuts on the rear side of the pushed portion 600. The elastic strips 611 protrude from the base 610 and each elastic strip 611 has a distal end abutting on the front side of the shell 50. The elastic member 61 may be a spring or a bent strip.

Figure 6:
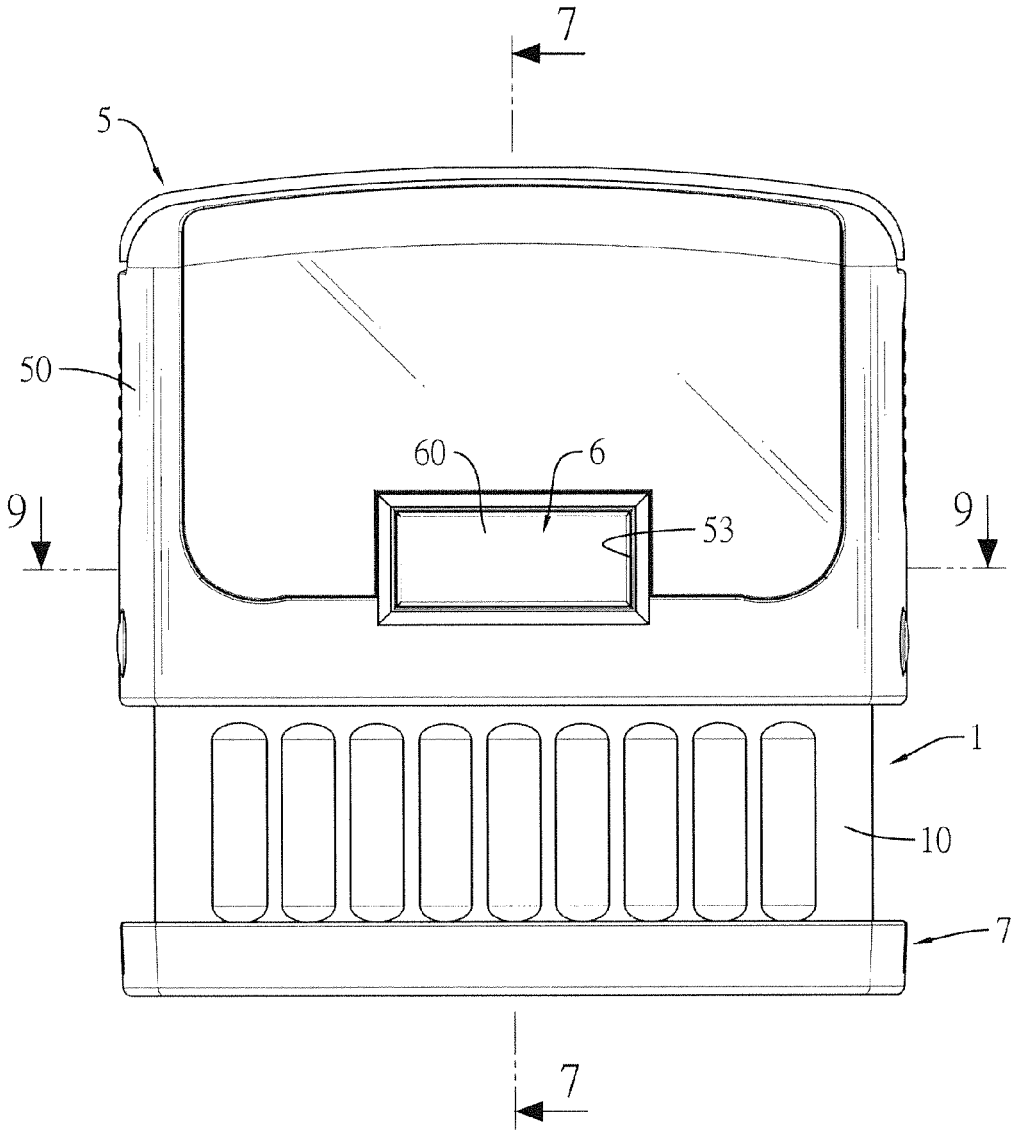
FIG. 6 is a front view of the stamp assembly in FIG. 1.

With reference to FIGS. 1, 6 and 7, the bottom cover 7 covers the bottom of the main body 10 of the bracket 1.

Accordingly, the bottom cover 7 can prevent a user from accidentally touching the ink cartridge 3 or the stamping member 2.

With reference to FIG. 7, the stamp assembly in accordance with the present invention is being operated to stamp a mark on an object.

First, the bottom cover 7 is removed from the bottom of the main body of the bracket 1.

Second, the bottom of the main body 10 of the bracket 1 is faced toward the object, and the housing 5 is pushed and moved downwardly along the grooves 12, and the spring 4 is compressed. During the movement of the housing 5, the driven sections are rotated by the guiding portions 13. Accordingly, the seat 20 and the pad 22 are also rotated.

Third, the pad 22 is abutted on the object and stamps the mark on the object.

Finally, the housing 5 is released, and the spring 4 provides a recoil force to drive the housing 5 to move upwardly. During the movement of the housing 5, the driven sections are rotated by the guiding portions 13. Accordingly, the seat 20 and the pad 22 are also rotated, and the housing 5 returns to an original position.

Figure 8:
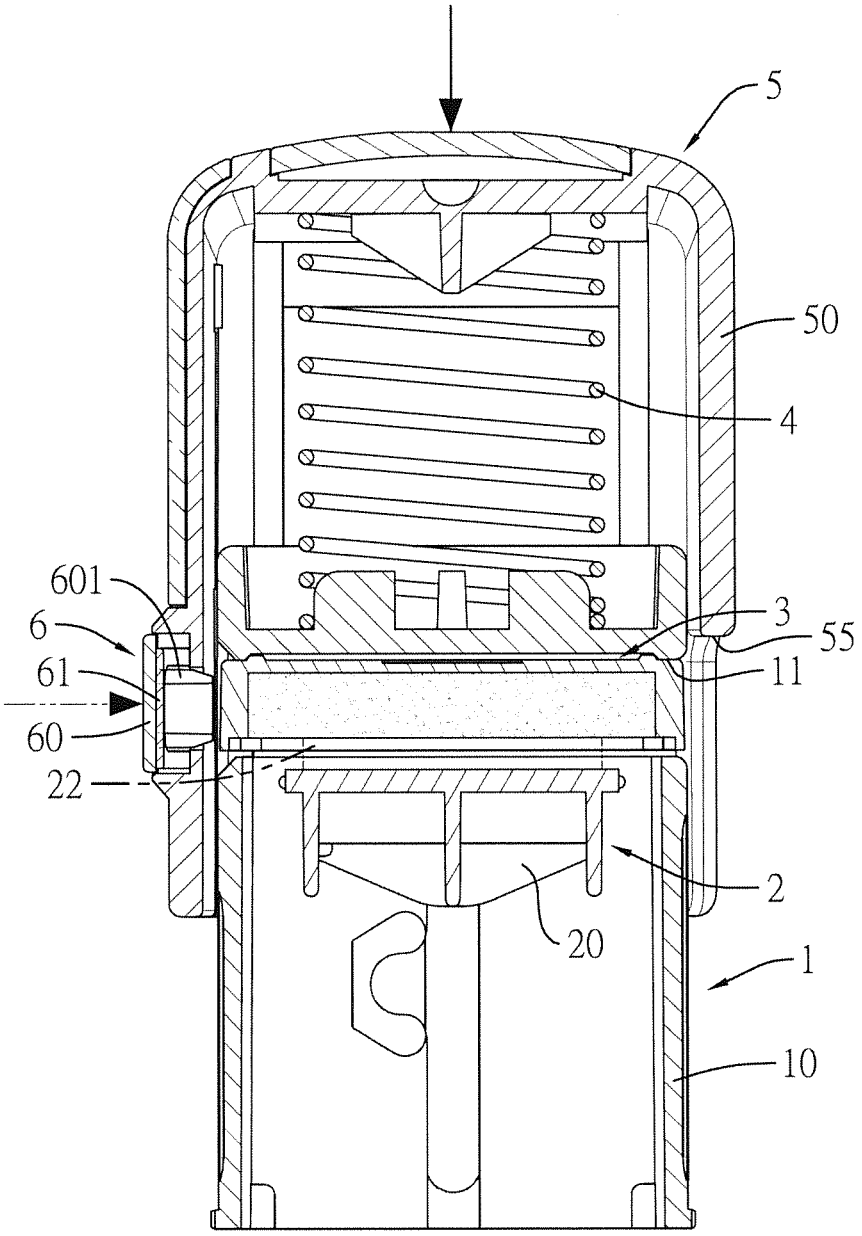
FIG. 8 is an operational side view in partial section of the stamp assembly in FIG. 7 showing that the housing is pushed downwardly.
Figure 10:
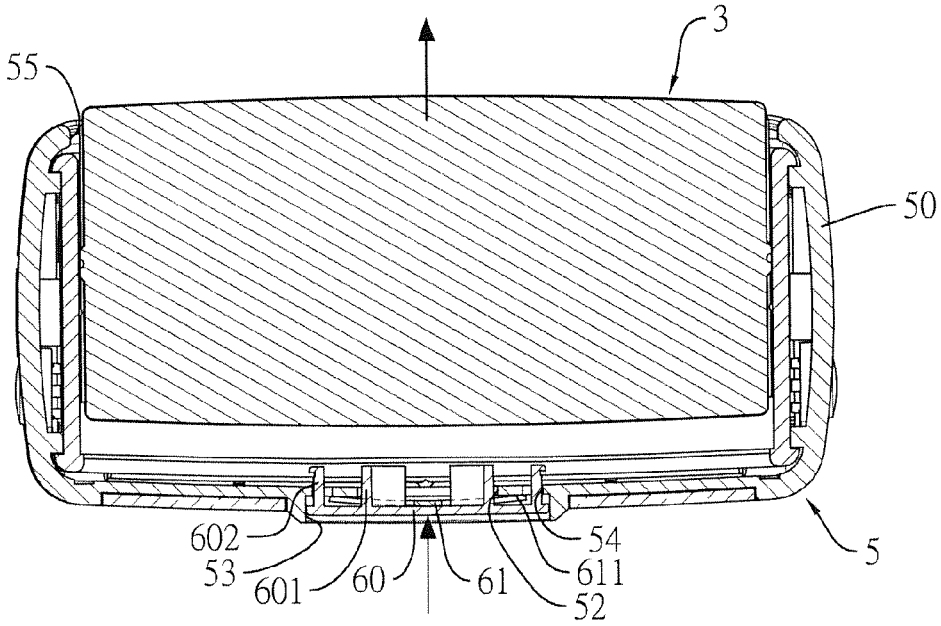
FIG. 10 is an operational cross sectional top view of the stamp assembly in FIG. 9 showing that the ink cartridge is pushed out of the bracket.

With reference FIGS. 8 to 10, when the ink cartridge 3 runs out of ink, the steps of replacing the ink cartridge 3 are described as follows.

First, the housing 5 is pushed downwardly for a specific distance until the ink cartridge 3 faces the shell hole 55 and the through hole 52.

Second, the two buttons 51 are pushed such that the buttons 51 are securely connected with the bracket 1, and the housing 5 is secured to the bracket 1.

Finally, the pushed member 60 is pushed such that the protrusions 601 push the ink cartridge 3 out of the bracket 1. Accordingly, the ink cartridge 3 can be removed for replacement. When the pushed member 60 is pushed, the elastic member 61 is simultaneously compressed.

Figure 11:
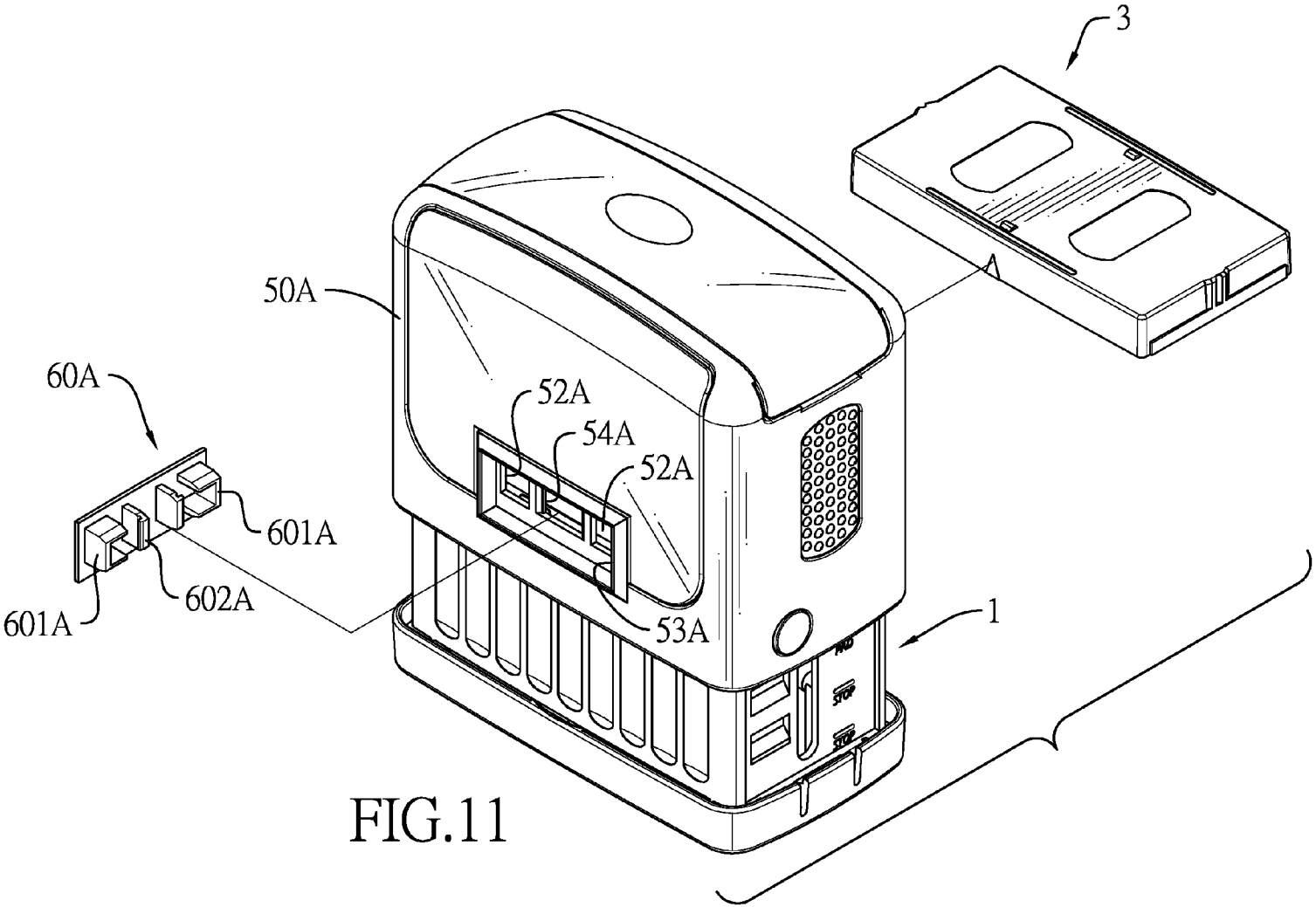
FIG. 11 is a partially exploded perspective view of a second embodiment of a stamp assembly in accordance with the present invention.
Figure 12:
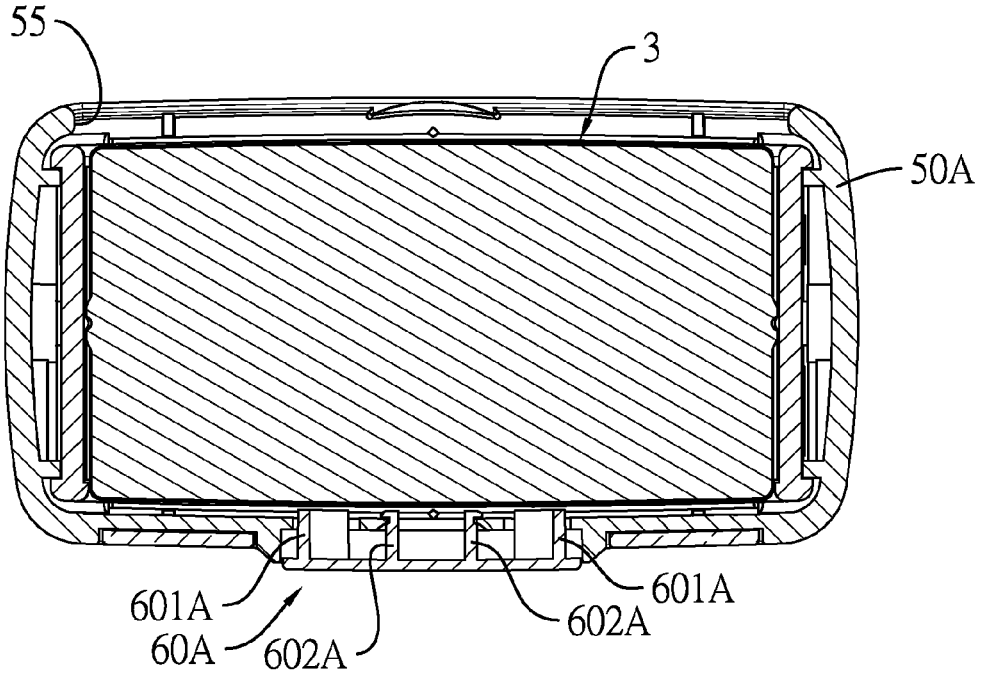
FIG. 12 is a cross sectional top view of the stamp assembly in FIG. 11.
Figure 13:
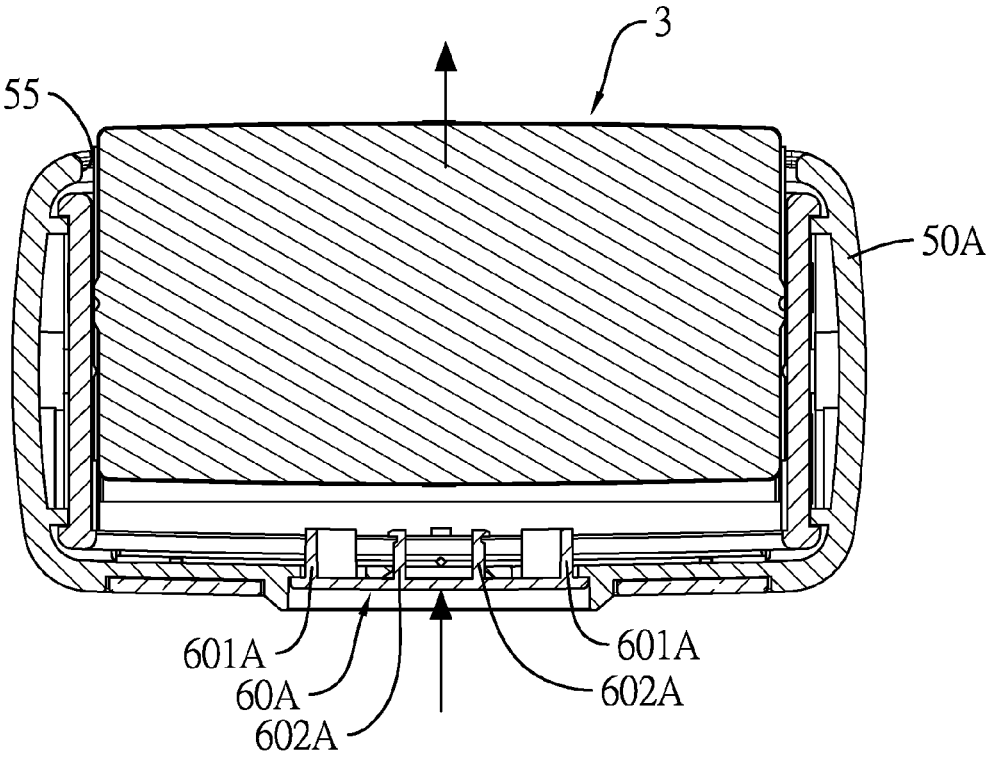
FIG. 13 is an operational cross sectional top view of the stamp assembly in FIG. 12 showing that the ink cartridge is pushed out of the bracket.
Figure 14:
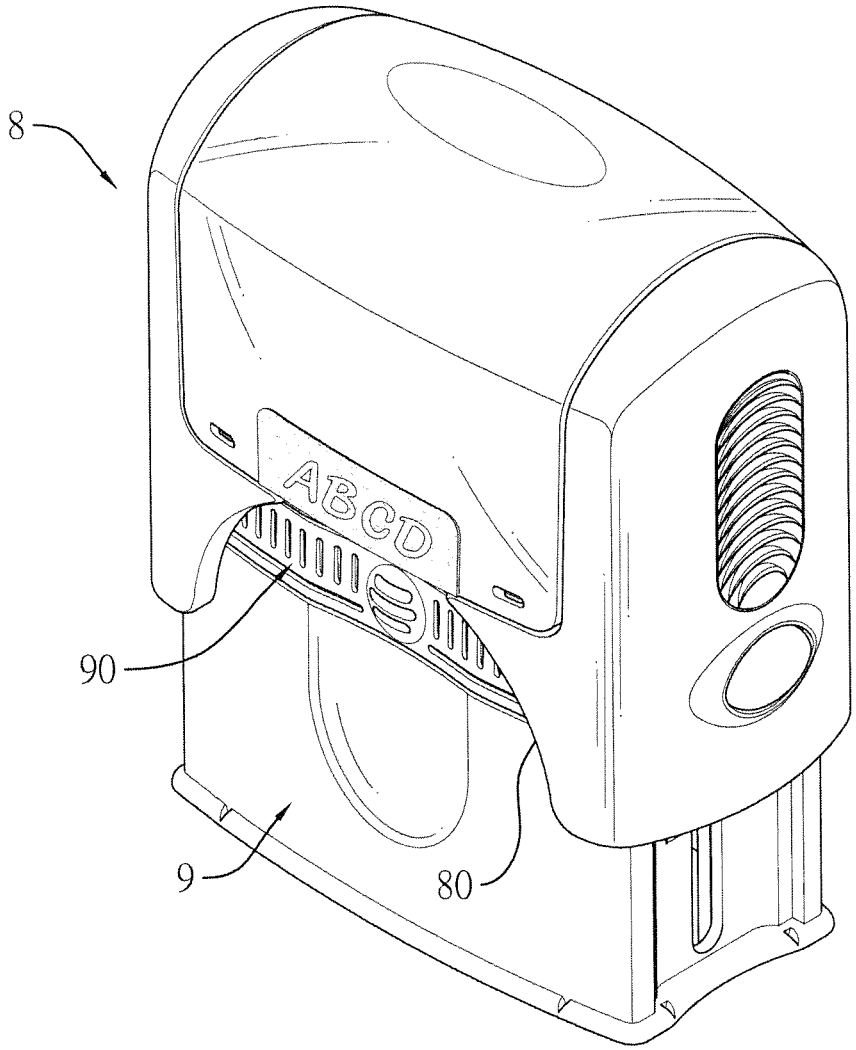
FIG.14 PRIOR ART
FIG. 14 is a perspective view of a conventional stamp assembly in accordance with the prior art.

With reference to FIGS. 11 to 13, a second embodiment of the stamp assembly is substantially the same as the first embodiment.

The shell 50A has a recess 53A, two through holes 52A and an aperture 54A.

The recess 53A is formed in the front side of the shell 50A and has a bottom. The through holes 52A and the aperture 54A are formed through the bottom of the recess 53A. The two through holes 52A are respectively adjacent to the aperture 54A on two opposite sides of the aperture 54A.

The two protrusions 601A are respectively mounted through the two through holes 52A, and are capable of pushing the ink cartridge 3.

The two hooks 602A are inserted into the aperture 54A, and are both located between the two protrusions 601A.

The operation of the second embodiment is substantially the same as that of the first embodiment.

From the above description, it is noted that the present invention has the following advantages:

The pushed member 60,60A of the pushing device 6 provides an enlarged portion for a user to push. Accordingly, the user can easily push the pushed member 60 and remove the ink cartridge 3. Furthermore, hands of the user are kept from being stained by the ink. Moreover, the shell 50 does not require a conventional front recess on the front side of the shell 50. As the ink cartridge 3 is hidden from sight, a front side of the stamp assembly has a visually-appealing appearance.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stamp assembly comprising:

a bracket having a top; and a bracket hole formed through the top of the bracket in a latitudinal direction of the bracket;

a stamping member mounted in the bracket below the bracket hole, and capable of being moved in a longitudinal direction relative to the bracket and being rotated;

an ink cartridge mounted in the bracket hole of the bracket;

a spring mounted in the bracket and having a top end; and a bottom end opposite to the top end of the spring and pressed against the top of the bracket;

a housing mounted around the bracket, capable of being moved in a longitudinal direction relative to the bracket, connected with the stamping member, and having a shell mounted around the bracket, capable of being moved in a longitudinal direction relative to the bracket, and having a front side;

a rear side opposite to the front side of the shell; and two opposite flanks;

a through hole formed through the front side of the shell;

an aperture formed through the front side of the shell and adjacent to the through hole; and a shell hole formed through a bottom of the rear side of the shell such that a bottom surface of the rear side of the shell is located above a bottom surface of the front side of the shell, wherein the ink cartridge is located between the shell hole and the through hole; and a pushing device mounted on the front side of the shell, the pushing device having a pushed member slidably mounted in the through hole of the housing and capable of pushing the ink cartridge out of the bracket, the pushed member having a pushed portion having a front side; and a rear side opposite to the front side of the pushed portion;

at least one protrusion mounted on the rear side of the pushed portion, mounted through the through hole, and capable of pushing the ink cartridge; and a hook mounted on the rear side of the pushed portion beside the at least one protrusion, mounted through the aperture, and capable of restricting movement of the pushed member.

2. The stamp assembly as claimed in claim 1, wherein the shell further has a recess formed in the front side of the shell and having a bottom, wherein the through hole and the aperture are formed through the bottom of the recess; and an additional aperture formed through the bottom of the recess of the shell, wherein the two apertures are respectively adjacent to the through hole on two opposite sides of the through hole;

the pushed member further has an additional hook mounted on the rear side of the pushed portion, wherein the two hooks are respectively inserted into the two apertures;

the number of the at least one protrusion is two; and the two protrusions are both located between the two hooks, are mounted through the through hole, and are capable of pushing the ink cartridge.

3. The stamp assembly as claimed in claim 2, wherein the pushing device further has an elastic member mounted between the pushed member and the shell.

4. The stamp assembly as claimed in claim 2, wherein the pushing device further has an elastic member mounted between the pushed member and the shell, located between the protrusions between the hooks, and having a base abutting on the rear side of the pushed portion; and multiple elastic strips protruding from the base, each elastic strip having a distal end abutting on the front side of the shell.

5. The stamp assembly as claimed in claim 1, wherein the shell further has a recess formed in the front side of the shell and having a bottom, wherein the through hole and the aperture are formed through the bottom of the recess; and an additional through hole formed through the bottom of the recess of the shell, wherein the two through holes are respectively adjacent to the aperture on two opposite sides of the aperture;

the pushed member further has an additional hook mounted on the rear side of the pushed portion, wherein the two hooks are inserted into the aperture;

the number of the at least one protrusion is two;

the two hooks are both located between the two protrusions; and the two protrusions are respectively mounted through the two through holes, and are capable of pushing the ink cartridge.

6. The stamp assembly as claimed in claim 5, wherein the pushing device further has an elastic member mounted between the pushed member and the shell.

7. The stamp assembly as claimed in claim 1, wherein the pushing device further has an elastic member mounted between the pushed member and the shell.

* * * * *